United States Patent [19]

Wecker

[11] 3,975,846

[45] Aug. 24, 1976

[54] ELECTRONIC CALENDAR SYSTEM

[76] Inventor: Leon S. Wecker, 700 NE. 14th Ave., Hallandale, Fla. 33009

[22] Filed: Jan. 27, 1975

[21] Appl. No.: 544,111

[52] U.S. Cl. ..... 40/107; 58/4 A
[51] Int. Cl.[2] ..... G09D 3/00; G04B 19/24
[58] Field of Search ..... 40/107; 58/4 A, 50

[56] References Cited

UNITED STATES PATENTS

| | | | |
|---|---|---|---|
| 3,738,099 | 6/1973 | Tanaka | 40/107 X |
| 3,796,037 | 3/1974 | Fujita | 40/107 X |
| 3,797,222 | 3/1974 | Kato | 58/4 A |

*Primary Examiner*—Louis G. Mancene
*Assistant Examiner*—John H. Wolff
*Attorney, Agent, or Firm*—William E. Mouzavires

[57] ABSTRACT

Methods and circuitry by which standard solid state, incadescent, or chemical alpha or numeric displays may be excited in proper sequence either from an A.M. or P.M. indicator, or any other electronic pulse, whether initially derived from an electrical or mechanical source, that appears one or more times during a 24 hour period.

3 Claims, 1 Drawing Figure

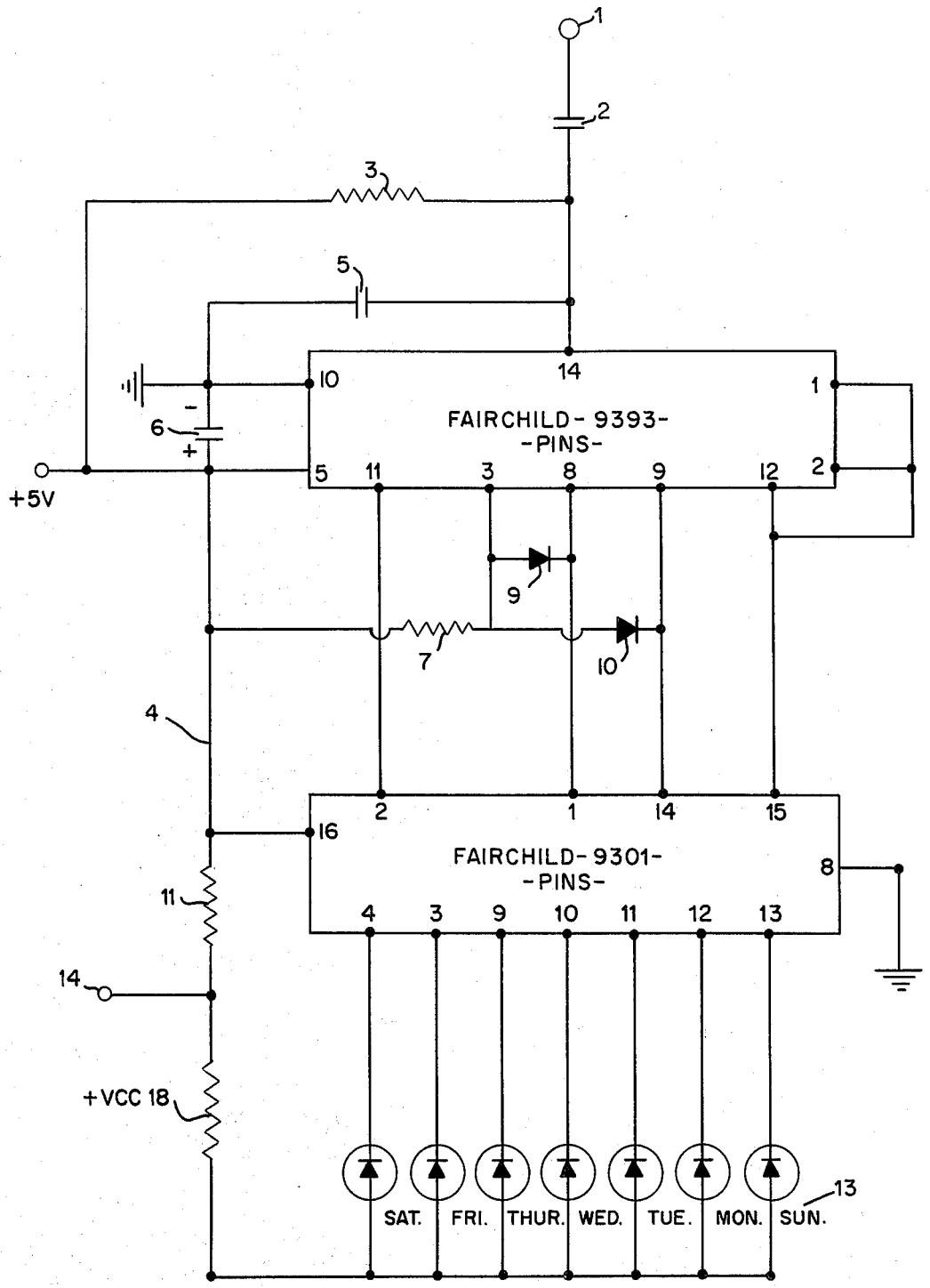
1
2
3
5
14
10
1
FAIRCHILD-9393-
-PINS-
6
-
+
+5V
5
11
3
8
9
12
2
9
7
10
4
2
1
14
15
16
FAIRCHILD-9301-
-PINS-
8
11
4
3
9
10
11
12
13
14
+VCC 18
13
SAT.
FRI.
THUR.
WED.
TUE.
MON.
SUN.

ELECTRONIC CALENDAR SYSTEM

BACKGROUND OF INVENTION AND OBJECTIVES

This invention relates to electronic calendars which are driven by an electronic pulse every 24 hours and whose end product is a visible display of the calendar day, and or date.

Electronic calendars of the foregoing type, using only numeric displays, have been noisy when placed in close proximity of a radio. This problem usually arises because of the use of multiplexed or strobe type systems. The noise is caused by high current switching arrangements, ocurring at high frequencies. This system is commonly used in calculators and calendar clocks. Equipment used to overcome the noise problem is usually cumbersome and expensive.

It has therefore been difficult if at all possible to manufacture an economical electronic calendar for assembly with a radio in a common cabinet.

Accordingly, it is an important object of the present invention to provide an economical electronic calendar having silent operation and capable of producing alpha as well as numeric displays and making it well suited for operation with a clock radio. Included herein is such a calendar that may be incorporated in or added to either mechanical or electronic clocks of conventional manufacture, although the invention is not limited thereto.

A further object is to provide novel circuitry for carrying out the above objects. Referring to the drawing in detail, there is schematically illustrated one embodiment of the invention wherein positive voltage is applied to the input 14, which enters a voltage divider supplying, through limiting resistor 18 proper current to the displays 13, also through resistor 11, 5 volts is obtained at 4, this supplies 5 volts to both integrated circuits.

An electronic pulse enters the Fairchild 9393 counter integrated circuit at 1, through a 0.02 isolating capacitor once every 24 hours. 5 volts is applied to 3, an isolating 10,000 ohm resistor connected to pin 14 of the 9393 counter integrated circuit pin 14, is also bypassed to common through a 0.01 filter capacitor 5. A 25 microfarad capacitor 6, is used to smooth out any power supply irregularities.

The output of this 9393 integrated circuit counter is the binary encoded digits of the numbers 1 through 8. These outputs are in the order pins 11, 8, 9, and 12. As there are 7 days in the week, the eighth binary encoded digit is not needed. Therefore pin 12 is connected to pins 1 and 2 in conjunction with pin 3, to reset the counter when it reaches the eighth pulse. A 10,000 ohm power supply isolation resistor 7, and two silicon diodes 9 and 10 are used to reset the calendar to the first day, upon receiving the eighth pulse which is conveyed to the reset line within the 9393 integrated circuit counter.

The second integrated circuit is a Fairchild 9301 binary 1 of 10 decoder driver. The inputs to this device are pins 2, 1, 14, 15, which receive the binary encoded pulses from the 9393 integrated circuit counter. These pulses are decoded within the 9301 integrated circuit and the outputs are activated in sequence through internal bipolar transistors from pins 13, 12, 11, 10, 9, 3, and 4, representing the days of the week. The lighted displays represented here, 13, are light emitting diodes which are in common use at this time, such as the Opcoa Company OPL-209 device. Incodescent lamps or liquid crystal displays may also be used here. As an example, resetting the calendar may be accomplished by activating the counter 9393 integrated circuit input, 1, with recurring pulses from the A.M. output of an electronic clock until the desired day is reached. Electronic clocks have power failure indicators included, which causes the A.M. or P.M. indicator to flash. A clock may be turned off, when turned on again, the flashing occurs. This causes the display lamps to sequence to the desired day in the week. Upon setting the time, the flashing stops and the set day of the week remains fixed until the next inputs from the A.M. indicator causes the lamp to move to the next day.

What is claimed is:

1. An electronic calendar for use as an attachment to a conventional electronic clock producing an AM pulse every 24 hours; the electronic calendar including a binary counter encoder adapted to be driven by an AM pulse of a conventional electronic clock to produce an output of binary encoded digits, a decoder driver connected to the output of the binary counter encoder to be activated thereby, a visual display means connected to the decoder driver to be driven thereby to display calendar indicia, and reset means for resetting the binary counter encoder at predetermined pulse intervals, and wherein said binary counter encoder and decoder driver are each integrated circuits combined in a single unit.

2. The electronic calendar defined in claim 1 wherein said display means includes a plurality of light-emitting diodes.

3. The combination defined in claim 1 wherein the outputs of the decoder driver are transistors.

* * * * *